US007650889B2

(12) United States Patent
Plank

(10) Patent No.: US 7,650,889 B2
(45) Date of Patent: Jan. 26, 2010

(54) TOBACCO TASTER

(75) Inventor: Stephen R. Plank, Sun Valley, CA (US)

(73) Assignee: Tobacco Tasters, Inc., Studio City, CA (US)

( * ) Notice: Subject to any disclaimer, the term of this patent is extended or adjusted under 35 U.S.C. 154(b) by 546 days.

(21) Appl. No.: 11/654,347

(22) Filed: Jan. 17, 2007

(65) Prior Publication Data

US 2008/0047570 A1 Feb. 28, 2008

Related U.S. Application Data

(60) Provisional application No. 60/836,288, filed on Aug. 8, 2006.

(51) Int. Cl.
*A24F 1/28* (2006.01)

(52) U.S. Cl. ..... 131/191; 131/70; 131/184.2; 131/214; 131/180; 131/220

(58) Field of Classification Search ..... None
See application file for complete search history.

(56) References Cited

U.S. PATENT DOCUMENTS

| | | | | | |
|---|---|---|---|---|---|
| 3,158,158 | A | * | 11/1964 | Womack | 131/191 |
| 4,151,849 | A | * | 5/1979 | Beck | 131/180 |
| 4,190,150 | A | | 2/1980 | Bresell | |
| 4,214,658 | A | | 7/1980 | Crow | |
| 6,041,921 | A | | 3/2000 | Staiano et al. | |

* cited by examiner

*Primary Examiner*—Philip C Tucker
*Assistant Examiner*—Phu H Nguyen
(74) *Attorney, Agent, or Firm*—Lewis Brisbois Bisgaard & Smith; Sanford Astor

(57) ABSTRACT

A tobacco taster comprising an inner tube and an outer tube, the inner tube having a slightly smaller diameter than the outer tube, so that inner tube slides into outer tube with a frictional fit, inner tube having a hole, a basket shaped screen having a lip, the screen fitting into the hole in the inner tube, the lip of the screen overlapping the edge of hole, the outer tube having a hole, so that when the inner tube and the outer tube are connected by sliding the outer tube over the inner tube, the two holes are concentric.

10 Claims, 2 Drawing Sheets

TOBACCO TASTER

This application claims the benefit of U.S. Provisional Application Ser. No. 60/836,288, filed Aug. 8, 2006, which application is incorporated herein by reference in its entirety.

FIELD OF THE INVENTION

This invention comprises a smoking system that provides a disposable pipe for a one-time tasting of a tobacco product.

BACKGROUND OF THE INVENTION

When a buyer (wholesale or retail) goes into a tobacco wholesaler or a retail tobacco store, to buy bulk tobacco, he or she often wants to taste a new variety offered by the seller. This is usually done in a pipe that the buyer brings along, not wanting to use a pipe that has been in someone else's mouth. However, using the same pipe to sample a variety of tobaccos, does not give a true taste result, because there is left-over tobacco or tobacco taste in the pipe from previous uses. Thus, there is a need for a simple, disposable, one-time use pipe device that can be discarded after tasting each sample.

SUMMARY OF THE INVENTION

The tobacco taster of this invention is a device for the one time tasting of tobacco, particularly premium tobacco, without an entire load of tobacco being necessary. The invention comprises two tubes, in which one tube has a slightly larger diameter than the other. The tube with the smaller diameter has a hole cut in it, in which is placed a small screen in the shape of a bowl, which has a lip around its upper surface. The screen is placed into the tube with the smaller diameter with the lip laying on the top surface of the tube.

The tube with the larger diameter also has a hole, which is matched up with the hole in the tube with the smaller diameter. The larger tube slides over the smaller tube trapping the lip of the screen between them. Since there is a tight fit between the tubes, the screen is held securely in place between the two tubes, with the two holes in a concentric position.

A small amount of tobacco can then be placed in the screen bowl to be lit and tasted and when the tasting is completed, the tube taster can be discarded and a new one used for tasting other another variety of tobacco.

The tubes are preferably constructed of cardboard coated with a flame resistant foil and a brass screen formed into a basket-like structure, which functions as the receptacle for the tobacco. The tobacco taster provides a device that allows for a safe and efficacious method for sampling tobaccos.

DETAILED DESCRIPTION OF THE INVENTION

Figure 1:
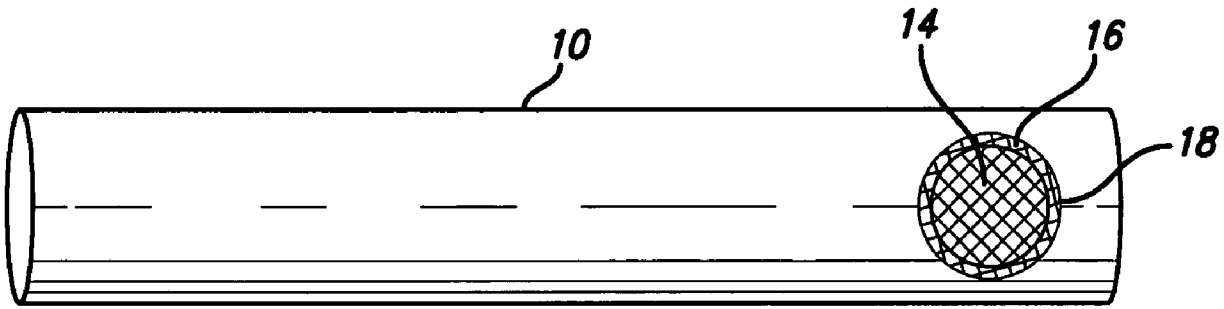
FIG. 1 is a top view of one tube of the invention.
Figure 2:
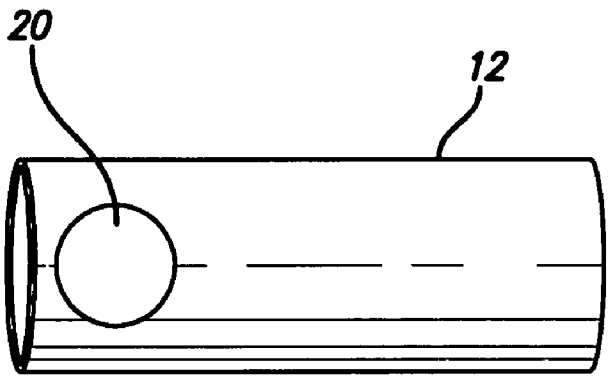
FIG. 2 is a top view of the other tube of the invention.
Figure 3:
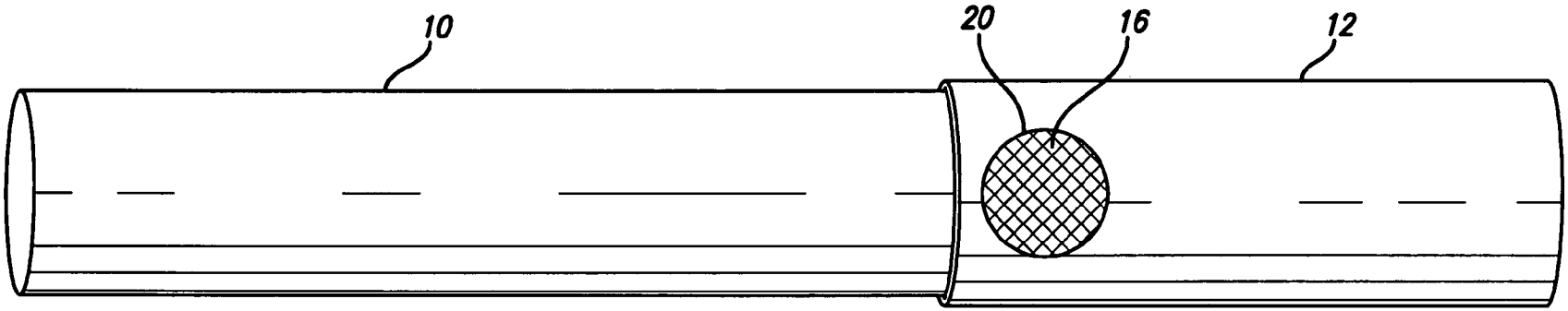
FIG. 3 is a top view of the assembled tubes.

Referring now to the drawings, there is shown a cylindrical inner tube 10 and a cylindrical outer tube 12. Inner tube 10 has a slightly smaller diameter than outer tube 12, so that tube 10 slides into tube 12 with a frictional fit. Inner tube 10 has a hole 14 through its outer surface, into which is placed a generally basket shaped screen 16, which has a lip 18, which overlaps the edge of hole 14 and lays flat against the outer surface of inner tube 10.

Outer tube 12 also has a hole 20, through its outer surface, which matches hole 14 of inner tube 10 so that when tubes 10 and 12 are connected by sliding tube 12 over tube 10, the holes 14 and 20 are substantially concentric. Preferably holes 14 and 20 are substantially the same diameter.

Figure 4:
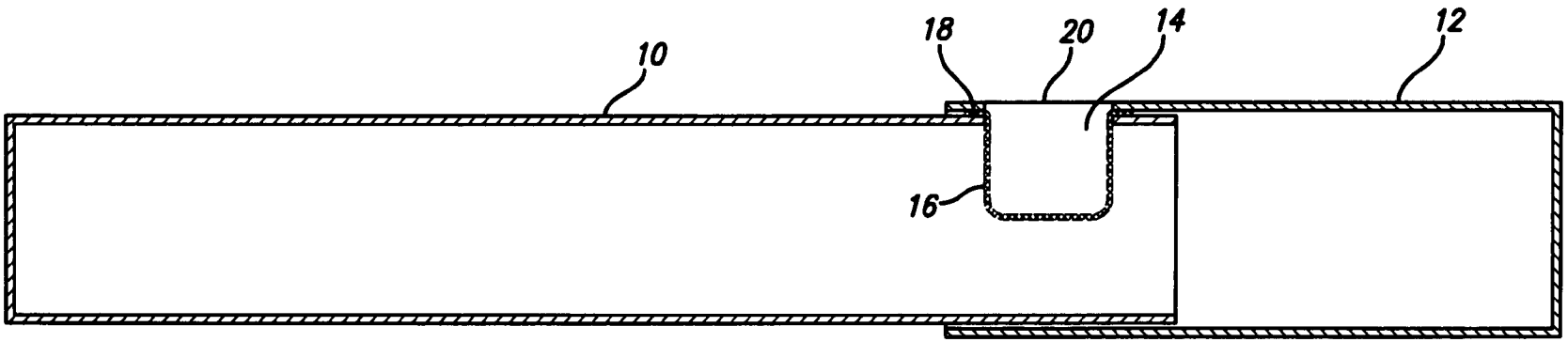
FIG. 4 is a cross-sectional view of the assembled tubes.

When tubes 10 and 12 are connected, lip 18 of screen 16 is trapped between the overlapped tubes and held tightly in place, as shown in FIG. 4. Tubes 10 and 12 are both open at both ends. Tobacco can be packed into screen bowl 16, lit and smoked for testing.

The tubes can be of any convenient length with inner tube 10 preferably being from about 2" to about 4" long and outer tube 12 preferably being from about 1" to about 2" long. The diameter of the tubes can also be of any convenient diameter with inner tube 10 being from about 0.2" to about 0.7" in outer diameter and outer tube 12 being from about 0.250" to about 0.750" in outer diameter. There is about a 0.025" difference between the outer diameter of tube 10 and the inner diameter of tube 12 to give a frictional fit and hold screen 16 in place. The diameter of the holes in both tubes is preferably about 3/16" to about 7/16" in diameter.

While the preferred material to make the tobacco taster tubes is cardboard covered with a with a flame resistant outer foil, due to its low cost and ease of manufacture, the tobacco taster may be made of other materials such as, glass, wood, stone, aluminum or brass. The preferred material for the screen is brass, but it may be made from aluminum, steel or other metals.

Low cost is important, since the tobacco taster of this invention is designed to have one use and then be discarded. Also while the device of this invention is designed for tasting tobacco, it could be used for tasting other smokable products.

Having thus described the invention, I claim:

1. A tobacco tasting pipe comprising a cylindrical inner tube and a cylindrical outer tube, both tubes open at both ends, the inner tube having a slightly smaller diameter than the outer tube, so that the inner tube slides into outer tube with a frictional fit, the inner tube having a hole through its outer surface, a basket shaped screen having a lip, the screen fitting into the hole in the inner tube, the lip of the screen overlapping the edge of hole, the outer tube having a hole through its outer surface, so that when the inner tube and the outer tube are connected by sliding the outer tube over the inner tube, the two holes are concentric and the two tubes bind the lip of the screen between them.

2. The tobacco tasting pipe of claim 1 in which the two holes have substantially the same diameter.

3. The tobacco tasting pipe of claim 1 in which the inner tube is from about 2 inches to about 4 inches long and the outer tube is from about 1 inch to about 2 inches long.

4. The tobacco tasting pipe of claim 1, in which the inner tube is from about 0.2 inches to about 0.7 inches in outer diameter and the outer tube is about 0.250 inches to about 07.750 inches in outer diameter.

5. The tobacco tasting pipe of claim 1 in which there is about a 0.025 inch difference between the outer diameter of the inner tube and the inner diameter of the outer tube to provide a frictional fit and hold the screen.

6. The tobacco tasting pipe of claim 1 in which the diameter of the holes in both tubes is about 3/16 inch to about 7/16 inch.

7. The tobacco tasting pipe of claim 1 in which the tubes are made of cardboard covered with a flame resistant foil, glass, wood, stone, aluminum or brass.

8. The tobacco tasting pipe of claim 1 in which the tubes are made of cardboard covered with a flame resistant foil.

9. The tobacco tasting pipe of claim 1 in which the screen is made of brass, aluminum, steel or other metals.

10. The tobacco tasting pipe of claim 1 in which the screen is made of brass.

* * * * *